US010045621B1

(12) United States Patent
Welter

(10) Patent No.: US 10,045,621 B1
(45) Date of Patent: Aug. 14, 2018

(54) ETERNAL CHAIR

(71) Applicant: James Norbert Welter, Lake Mills, WI (US)

(72) Inventor: James Norbert Welter, Lake Mills, WI (US)

( * ) Notice: Subject to any disclaimer, the term of this patent is extended or adjusted under 35 U.S.C. 154(b) by 0 days.

(21) Appl. No.: 14/519,001

(22) Filed: Oct. 20, 2014

(51) Int. Cl.

| | |
|---|---|
| ***A47C 1/034*** | (2006.01) |
| ***A47C 1/024*** | (2006.01) |
| ***A47C 7/50*** | (2006.01) |
| ***A47C 1/032*** | (2006.01) |
| ***A47C 1/12*** | (2006.01) |

(52) U.S. Cl.
CPC ..... *A47C 1/0347* (2013.01); *A47C 1/024* (2013.01); *A47C 1/12* (2013.01); *A47C 7/506* (2013.01)

(58) Field of Classification Search
CPC ..... A47C 1/02; A47C 1/0347; A47C 1/0352; A47C 1/03294; A47C 1/024; A47C 7/506
USPC ..... 297/325, 330, 342, 311, 337, 341
See application file for complete search history.

(56) References Cited

U.S. PATENT DOCUMENTS

| | | | | |
|---|---|---|---|---|
| 2,473,895 | A * | 6/1949 | Mednick | A47C 1/032 297/318 |
| 3,639,001 | A * | 2/1972 | Anderson | A47C 4/02 248/188.8 |
| 4,078,841 | A * | 3/1978 | Kiang | A47C 1/032 297/317 |
| 5,988,749 | A * | 11/1999 | Williams | A47C 17/134 297/337 |
| 6,106,065 | A * | 8/2000 | Carroll | A47C 1/0347 297/325 |
| 7,575,279 | B2 * | 8/2009 | Robertson | A47C 1/0242 297/330 |
| 8,308,228 | B2 * | 11/2012 | Lawson | A47C 1/035 297/330 |
| 2002/0063459 | A1 * | 5/2002 | Gaffney | A47C 1/0345 297/330 |
| 2008/0066672 | A1 * | 3/2008 | Eekhoff | B63B 29/04 114/363 |
| 2011/0084530 | A1 * | 4/2011 | Lockwood | A47C 1/03294 297/342 |
| 2014/0035336 | A1 * | 2/2014 | Robertson | A47C 1/032 297/340 |

* cited by examiner

*Primary Examiner* — David R Dunn
*Assistant Examiner* — Tania Abraham

(57) ABSTRACT

The eternal chair will function as an aid for young and old as a lift chair. The eternal chair is the first recliner/lift chair with no mechanism and a removable seat cushion. Each function of the eternal chair is controlled separately. The eternal chair could be used for obesity and or have the capability to fit the needs of those who are suffering from back injury or medical recovery.

4 Claims, 20 Drawing Sheets

RIGHT VIEW

ETERNAL CHAIR ASSEMBLY

SIDE VIEW

SEAT AND FOOTREST SEPERATION

RIGHT VIEW

FRONT VIEW

ETERNAL CHAIR ASSEMBLY

RIGHT VIEW

FRONT VIEW

2
SEAT AND BACK ASSEMBLY

D
D
D

TOP VIEW

FRONT VIEW

RIGHT VIEW
SEAT HOUSING

RIGHT VIEW

FRONT VIEW

SITTING ASSEMBLY PLATFORM

RIGHT VIEW

FRONT VIEW

SITTING ASSEMBLY PLATFORM

RIGHT VIEW

FRONT VIEW

SITTING UNIT ASSEMBLY

RIGHT VIEW

FRONT VIEW

SITTING UNIT ASSEMBLY

RIGHT VIEW

FRONT VIEW

CATCH AND RELEASE

FRONT VIEW

RIGHT VIEW

FRONT VIEW

SITTING ASSEMBLY PLATFORM

FRONT VIEW

CATCH

RIGHT VIEW

FRONT VIEW

CATCH AND RELEASE

SIDE VIEW

SIDE VIEW

ASSEMBLY WITH LIFT

SIDE VIEW

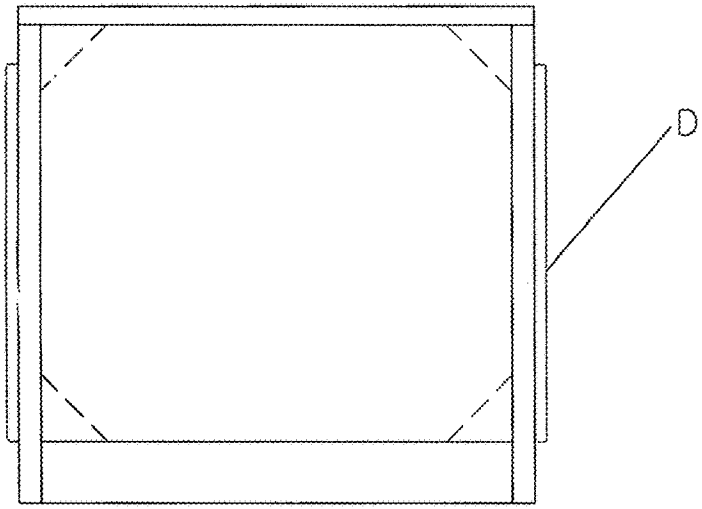
FIG 27
TOP VIEW
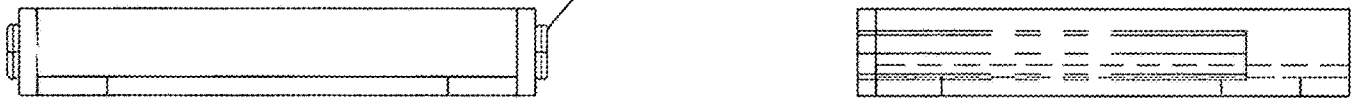
FIG 28
FRONT VIEW
FIG 29
RIGHT VIEW
FOOTREST PLATFORM

FRONT VIEW

15
GUIDE

TOP VIEW

FRONT VIEW

RIGHT VIEW

SITTING UNIT WITH GUIDE

RIGHT VIEW

FRONT VIEW

MOUNTING FOOTREST WITH GUIDE

SIDE VIEW

SIDE VIEW

SEAT AND FOOTREST SEPERATION

SIDE VIEW

SIDE VIEW

TOP VIEW

FOOTREST ASSEMBLY

SIDE VIEW EXTENDED

SIDE VIEW EXTENDED

FOOTREST EXTENTION

ETERNAL CHAIR

FIELD OF INVENTION

This invention relates to living room furniture, in particular but not exclusively, that is to be used for reclining/footrest operation/lifting and or theater seating with no mechanism, custom designed to specifically fit a person's sitting comfort and improving the quality of people's lives.

DESCRIPTION OF THE DRAWINGS

FIG. 27—The top view of the footrest platform with slides.

FIG. 28—The front view of the footrest platform with slides.

FIG. 29—The right view of the footrest platform with slides.

DETAILED DESCRIPTION

Figure 2:
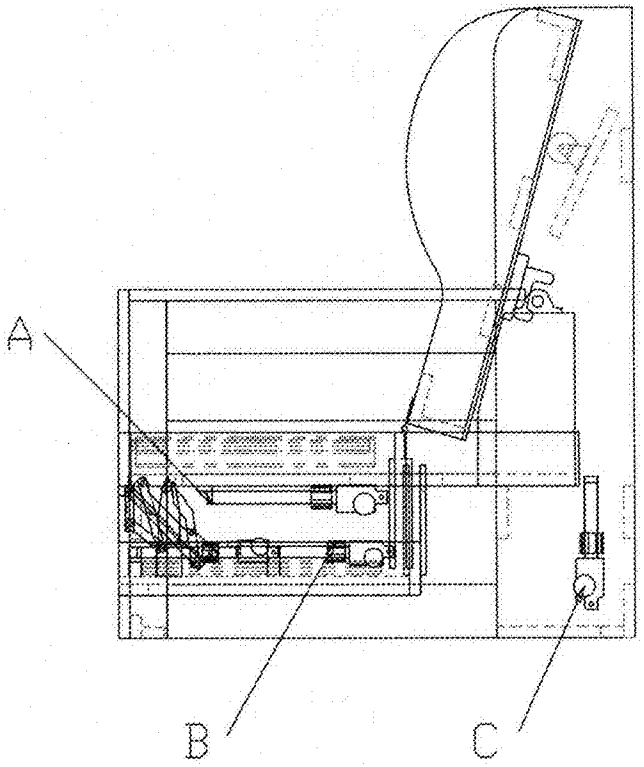
FIG. 2—Right view of eternal chair, this view shows each function functioning independently on its own actuator gilded by slides and controlled separately.
Figure 1:
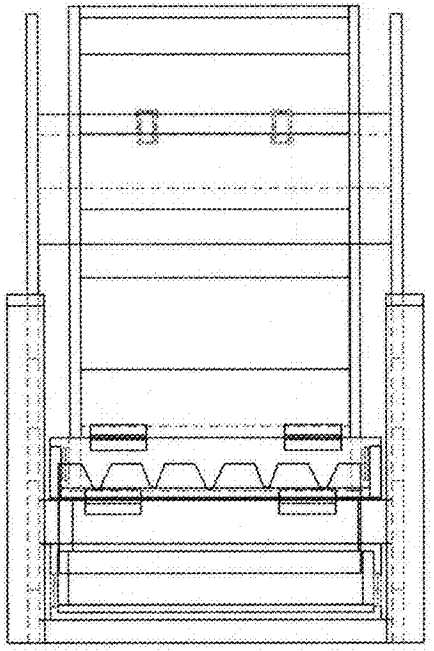
FIG. 1—Front view of eternal chair, this view shows each function functioning independently on its own actuator gilded by slides and controlled separately.

FIG. 1 and FIG. 2 show three motors/actuator, which independently control each function being able to start and stop at any given position. FIG. 2 shows an actuator using static force to control the seat, see A. FIG. 2 also shows an actuator controlling the footrest, see B, and FIG. 2 shows an actuator controlling the arching movement of the seat assembly, see C.

Figure 24:
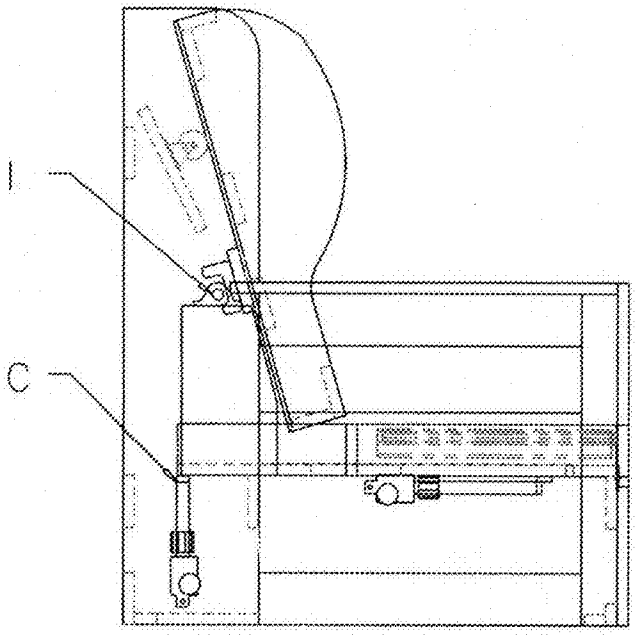
FIG. 24—The right side view of the eternal chair showing the seat assembly with seat and back being supported by the frame itself and rollers. It also shows the seat actuator mounted to the seat, including a second actuator used in lifting the seat assembly unit.
Figure 37:
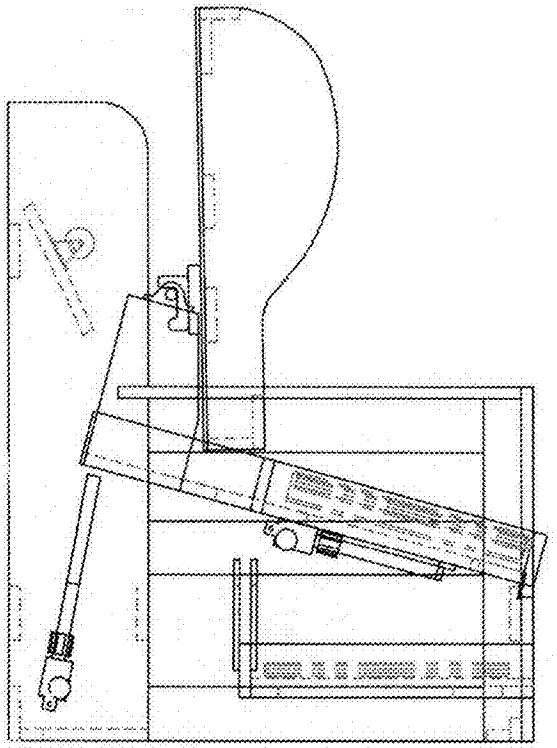
FIG. 37—The right side view of the eternal chair showing the seat assembly with footrest assembly in line with each other and yet allowing the seat and back assembly to move away.
Figure 36:
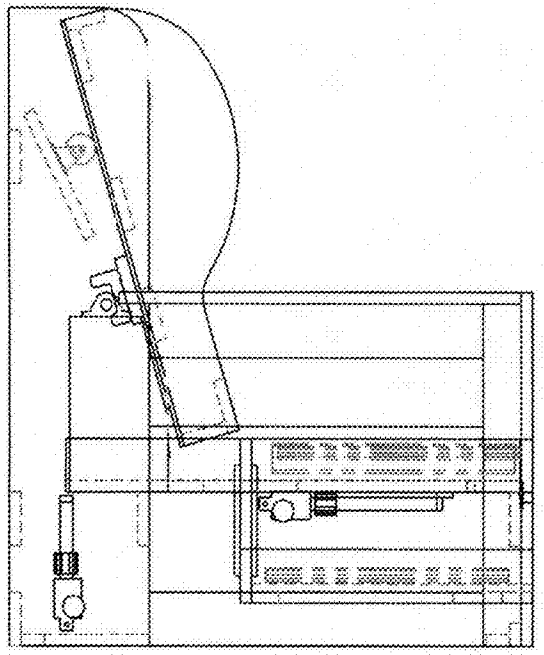
FIG. 36—The right side view of the eternal chair showing the seat assembly with footrest assembly in line with each other held horizontally together as one.

In FIG. 24 the lifting actuator C will not function unless the seat and back assembly and foot rest assembly are in their home position, see FIG. 37.

Seat and Back Assembly

The seat can be custom made to any size or shape. There are two ball retainer heavy-duty drawer slides each rated for a weight limit of 500 pounds, shown divided for simplicity in FIG. 3 and FIG. 4 that are mounted to the side of the seat horizontally and adjacent to each other see D.

Figure 4:
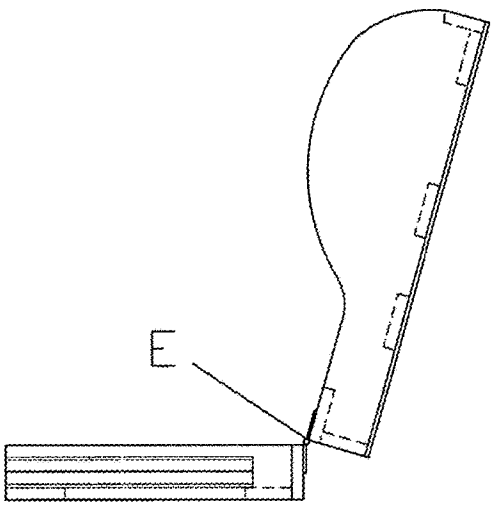
FIG. 4—The side view of the seat and back housing assembly.
Figure 3:
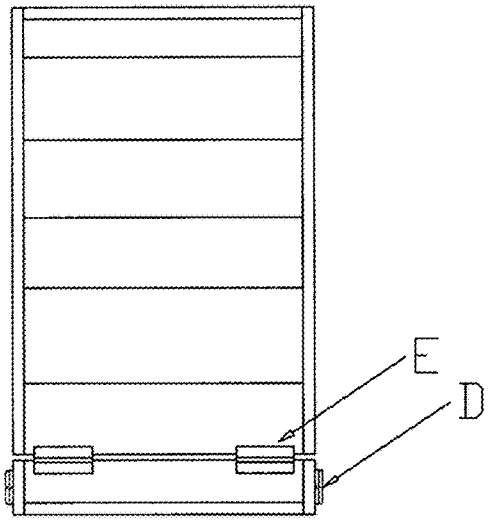
FIG. 3—The front view of the seat and back housing assembly, it also shows how the front view is attached to the slides and hinges.

The back can also be of any size, however must be the same width as the seat. FIG. 3 and FIG. 4 are showing the back hinged to the seat, see E; this will form the seat assembly see FIG. 4.

Figures 5, 6, 7:
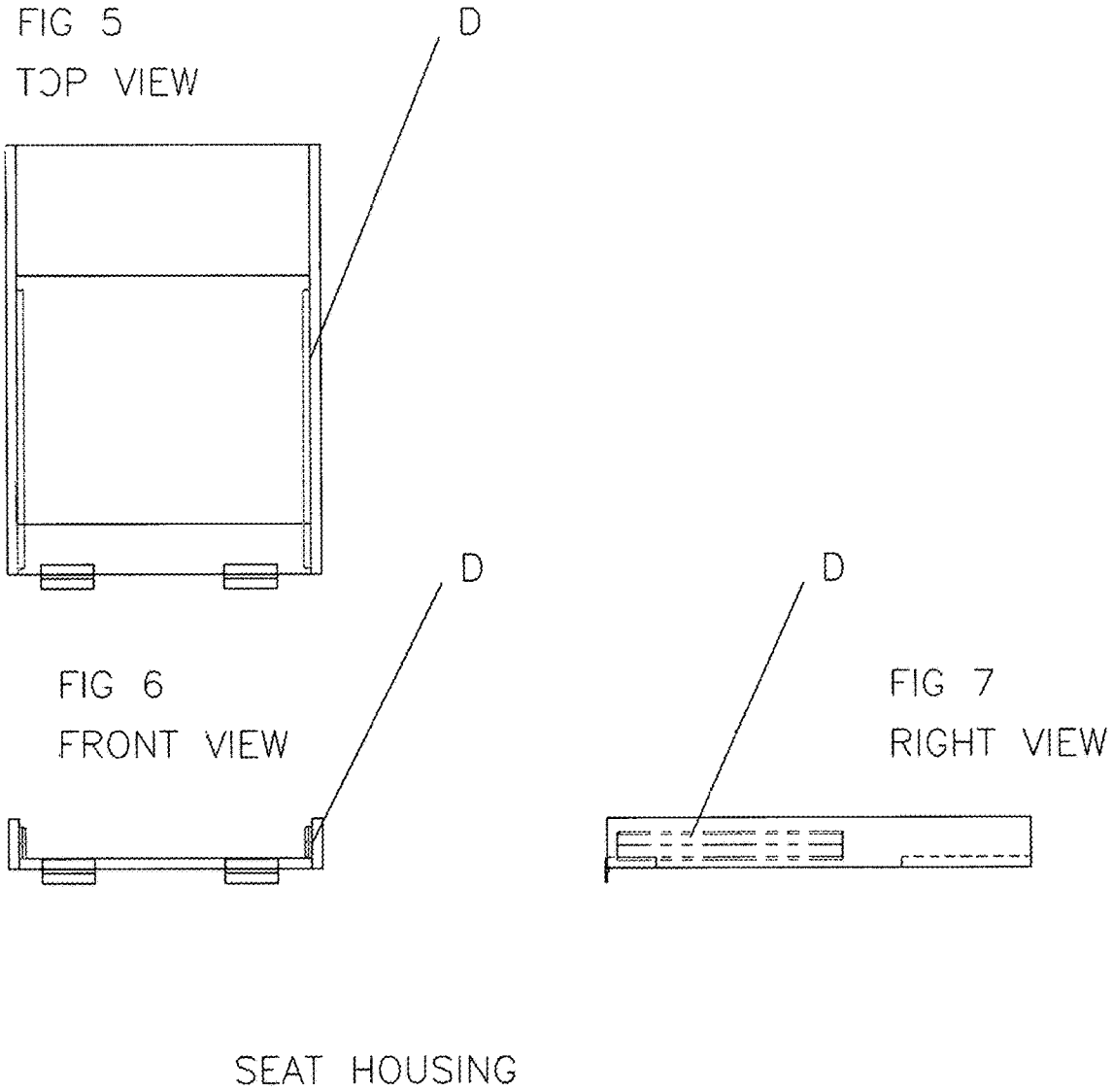
FIG. 5—The front view of the back with hinges attached.
FIG. 6—The front view of the seat housing with hinges attached.
FIG. 7—The right side view of the seat hosing with hinges attached.
Figure 9:
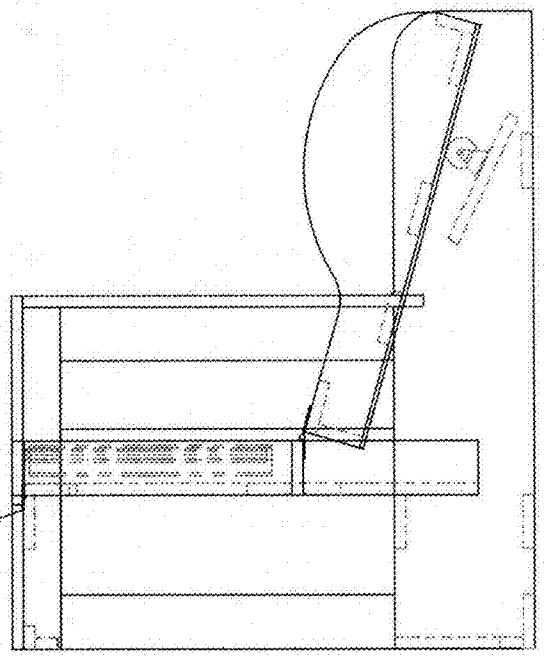
FIG. 9—The right side view of the sitting assembly platform, this view shows the seating housing assembly inside the frame itself.
Figure 8:
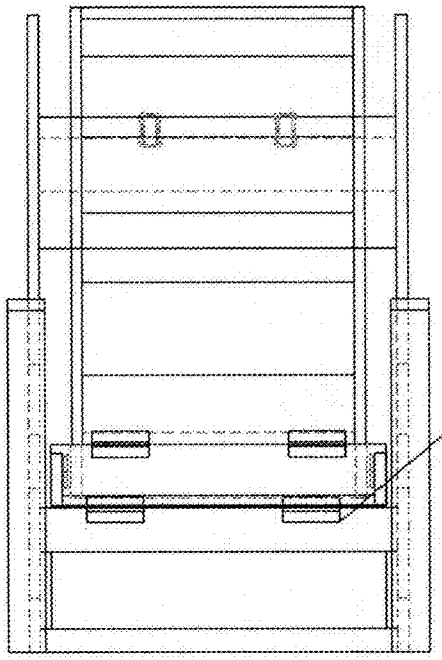
FIG. 8—Front view of sitting assembly platform, this view shows the seating housing assembly inside the frame itself.

FIG. 5-7 show the ball retainer heavy duty drawer slides of the seat and back assembly mounted horizontally to the seat housing in the same manner as they are in FIG. 3 and FIG. 4, see D; again shown divided for simplicity. The seat and back assembly slides are connected with the seat housing in FIGS. 5 and 6, providing a horizontal seat sliding extension. This function will develop the sitting unit assembly, see FIG. 9. The sitting unit assembly is then hinged, see E in FIG. 8 and FIG. 9, at the front horizontal cross member of the frame, see F in FIG. 10.

Figure 11:
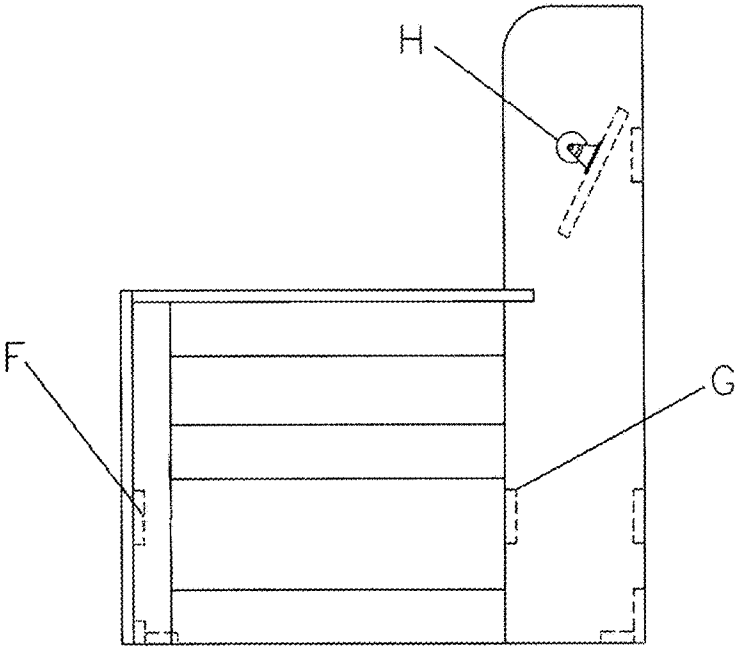
FIG. 11—The right side view of the frame itself with guild rollers and cross support, no seating housing assembly.

In order to provide a perfect seating assembly platform that is in alignment to a person's sitting profile, the seat assembly will rest on a second horizontal support, see G in FIG. 11, this position will be called home.

Figure 10:
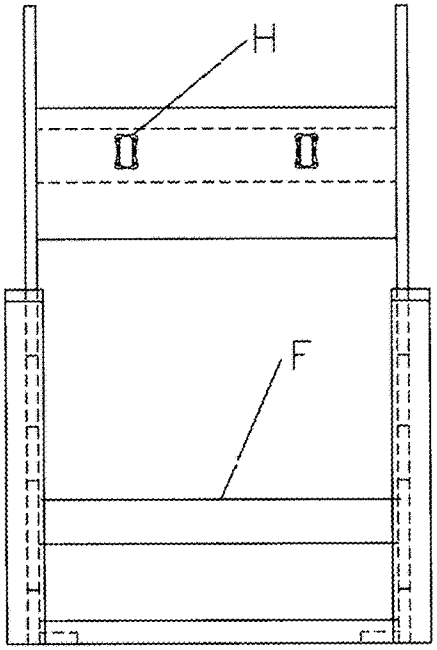
FIG. 10—The front view of the frame itself with guild rollers and cross support, no seating housing assembly.
Figure 13:
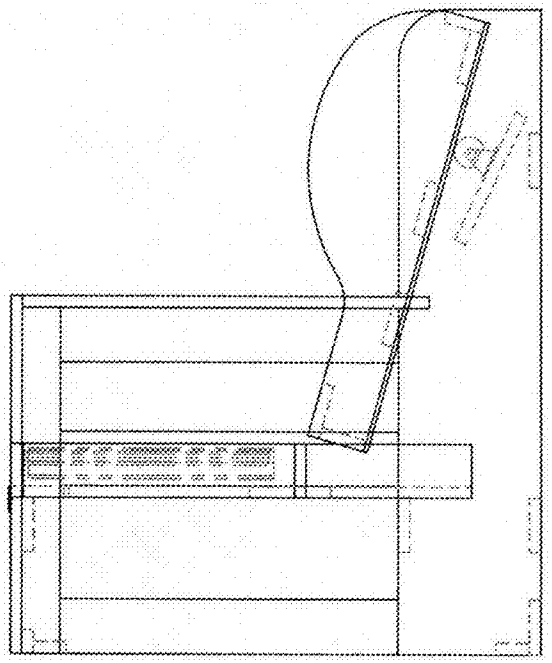
FIG. 13—The right side view of the sitting housing unit assembly, this view shows how the back is support and moves with the use of two rollers. This location is also flexible.
Figure 12:
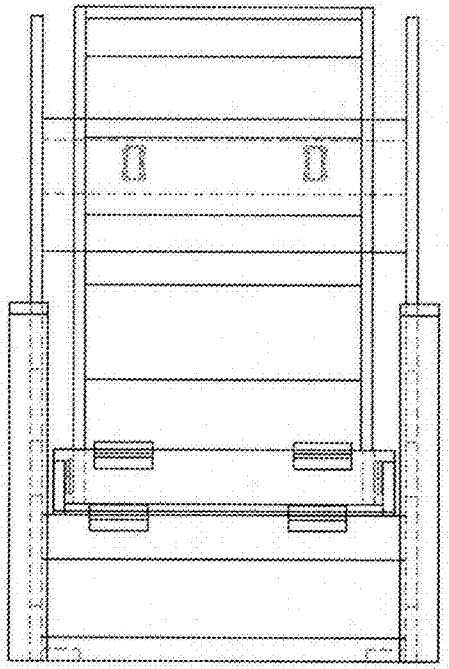
FIG. 12—The front view of the sitting housing unit assembly, this view shows how the back is supported and moves with the use of two rollers. This location is also flexible.

The upper portion of the back will rest against two wheels, view FIG. 10 and FIG. 11 see H. The location and diameter of the wheels will determine the vertical reclining angel of the back when the seat assembly is in its home position.

Figure 15:
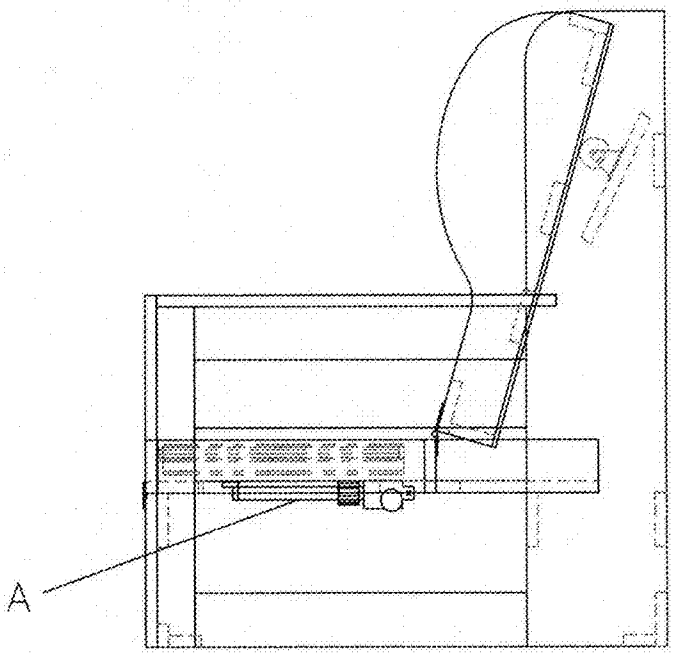
FIG. 15—The right side view of the eternal chair with the seat actuator mounted, this view also shows how the location of the rollers dictates the seat sliding availability.
Figure 14:
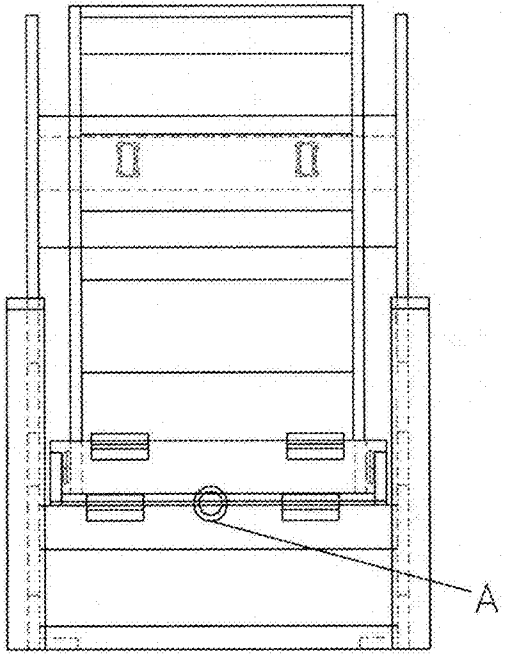
FIG. 14—The front view of the eternal chair with the seat actuator mounted.

A motor/track actuator rated with a static force of 400 pounds is fastened under the seat and back assembly, view FIG. 14 and FIG. 15 see A. This will control the horizontal movement; applying a push and pull on the lower portion of the back producing a reclining simulation.

Figure 17:
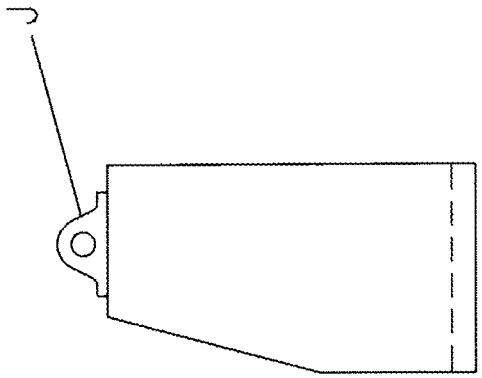
FIG. 17—The side view of the catch and release, this view also shows one of two pillow block bearings.
Figure 16:
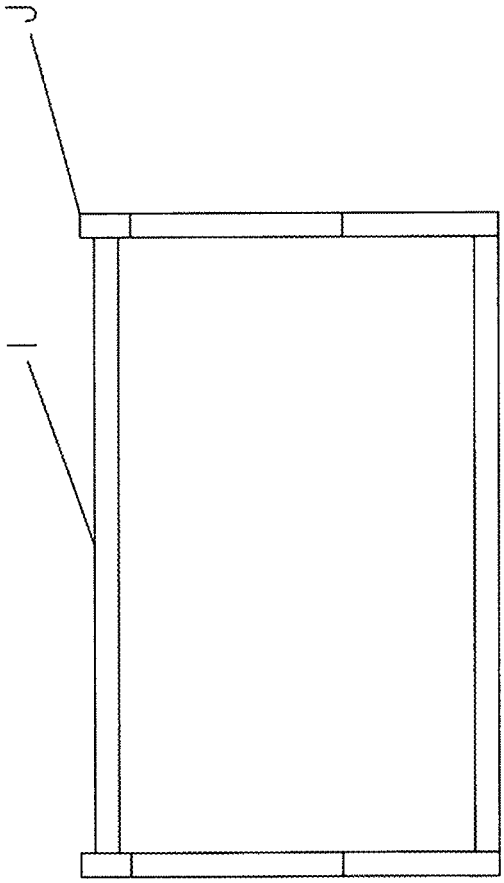
FIG. 16—The front view of the catch and release.

The catch and release assembly are shown in FIGS. 16 and 17; they are designed, sized and fitted for the lift. This assembly has a shaft shown in FIG. 16, see I; and two pillow blocks shown in FIG. 16 and FIG. 17, see J.

Figure 18:
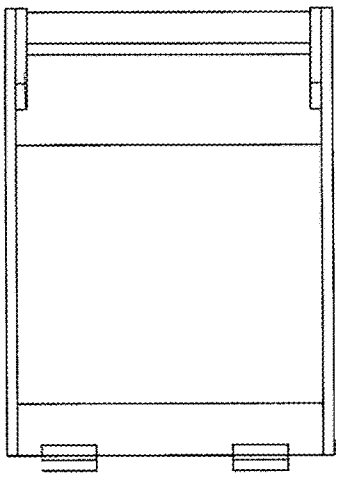
FIG. 18—The top view of the catch and release installed to the seating housing assembly with hinges.
Figure 20:
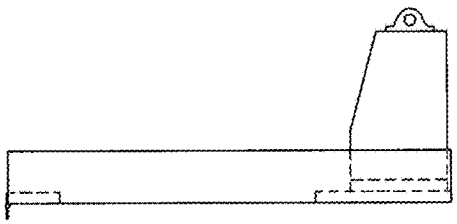
FIG. 20—The right side view of the catch and release installed to the seating housing assembly with hinges.
Figure 19:
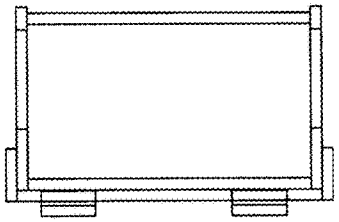
FIG. 19—The front view of the catch and release installed to the seating housing assembly with hinges.
Figure 21:
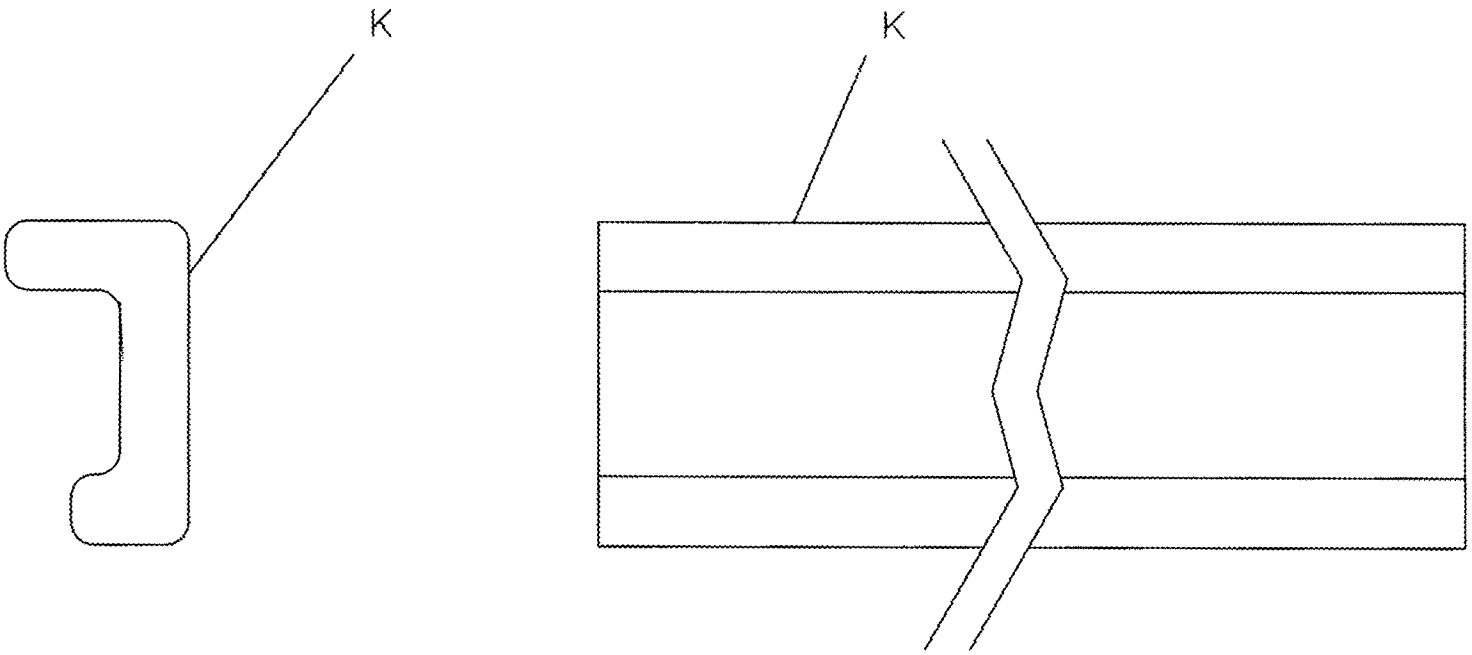
FIG. 21—The catch, made from PVC.
Figure 23:
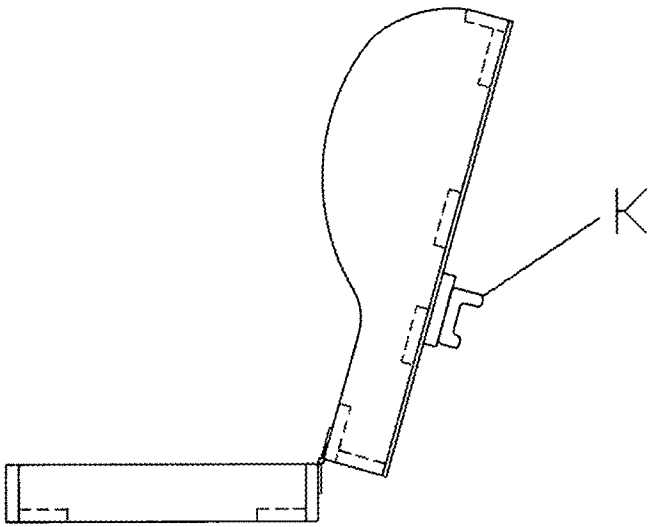
FIG. 23—The right side view of the seat and back assembly with the catch mounted to the back.
Figure 22:
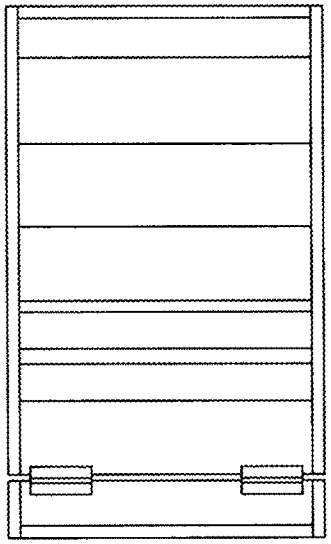
FIG. 22—The front view of the seat and back with the catch mounted.

The assembly is mounted at the back portion of the seat and back housing in FIGS. 18, 19, and 20. The catch shown in FIG. 21 is aligned and temporarily mounted to the outside back, view FIG. 23 see K; making sure of a perfect alignment between the catch and release, before permanently mounting.

The Lift Assembly

Figure 25:
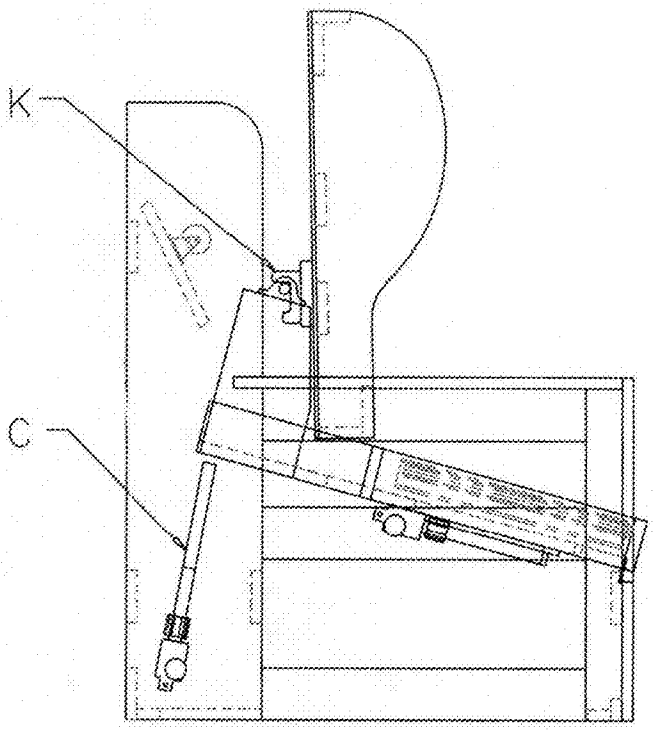
FIG. 25—The right side view of the eternal chair during a lift, the view shows the seat assembly being hinged to the frame, the view shows the seat actuator with static hold, holding the seat assembly in place, it also shows the lift actuator in action lifting the seat assembly with the catch and release assembly inter locking with the catch.

FIG. 24 and FIG. 25 show the activation of the motor/actuator, see C. The movement will raise the back portion of the sitting housing assembly; as it begins to lift the shaft, see I, it will engage with the catch shown in FIG. 25 see K, this will support and hold the back securely in place.

Figure 26:
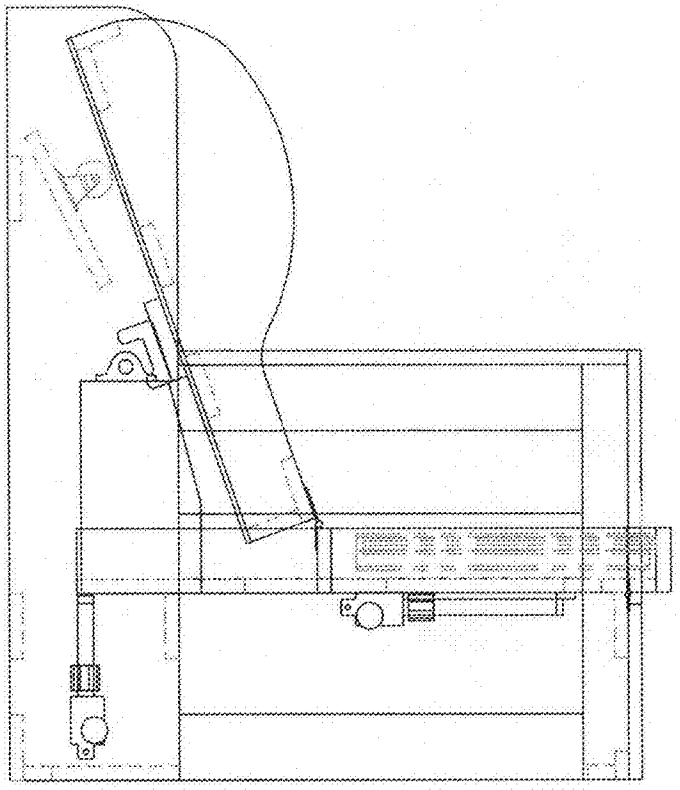
FIG. 26—The right side view of the eternal chair showing the seat assembly with seat and back being supported by the frame itself and rollers. Including how when the seat assembly actuator is activated it moves the seat attached to glides and the back follows the rollers missing the catch.

FIG. 26 shows the motor/actuator descending into its home position, a clearance from the catch is provided allowing the sitting unit assembly to transfer into the reclining position, thus as the sitting unit assembly moves away from the catch and release FIG. 26.

Footrest Assembly

Figure 35:
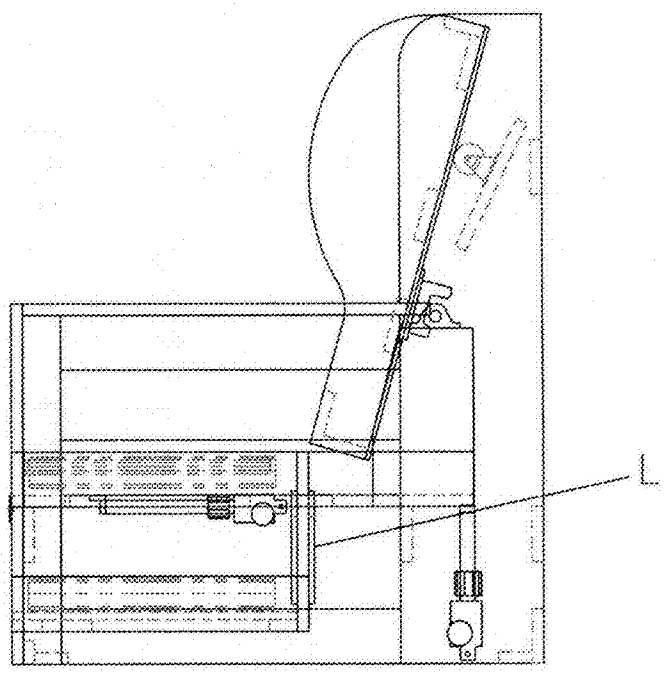
FIG. 35—The right view of the eternal chair showing the footrest assembly attached to slides, and seat guide in line with seat; allowing the two to travel together as one.
Figure 34:
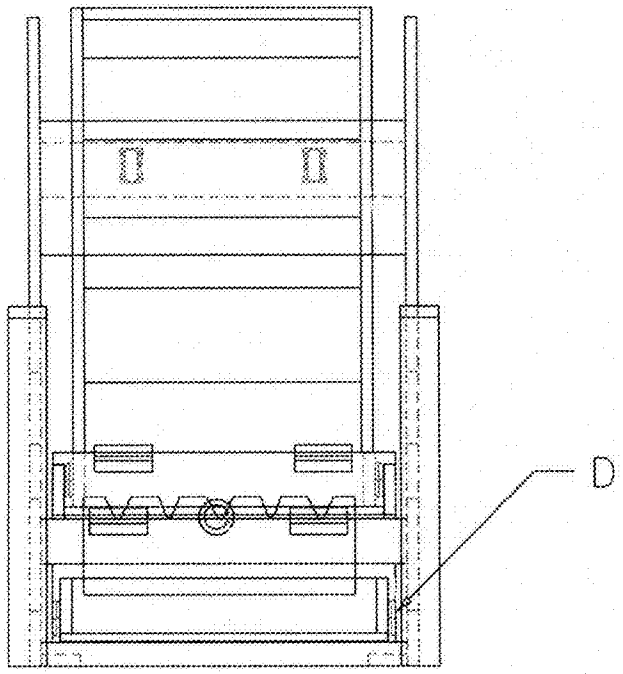
FIG. 34—The front view of the eternal chair with the footrest platform attached to slides with seat guild attached.

The footrest platform shown in FIGS. 27, 28, and 29 is showing a second set of ball retainer heavy-duty drawer slides each rated at 300 pounds or higher fastened to each side of the footrest platform, see D. The footrest platform is built at the same length as the seat of the sitting unit assembly. The width may vary slightly; this platform will be fastened to the frame under the sitting unit assembly, aligning the back of the footrest platform with the back of the sitting unit assembly, see FIG. 35.

Figure 30:
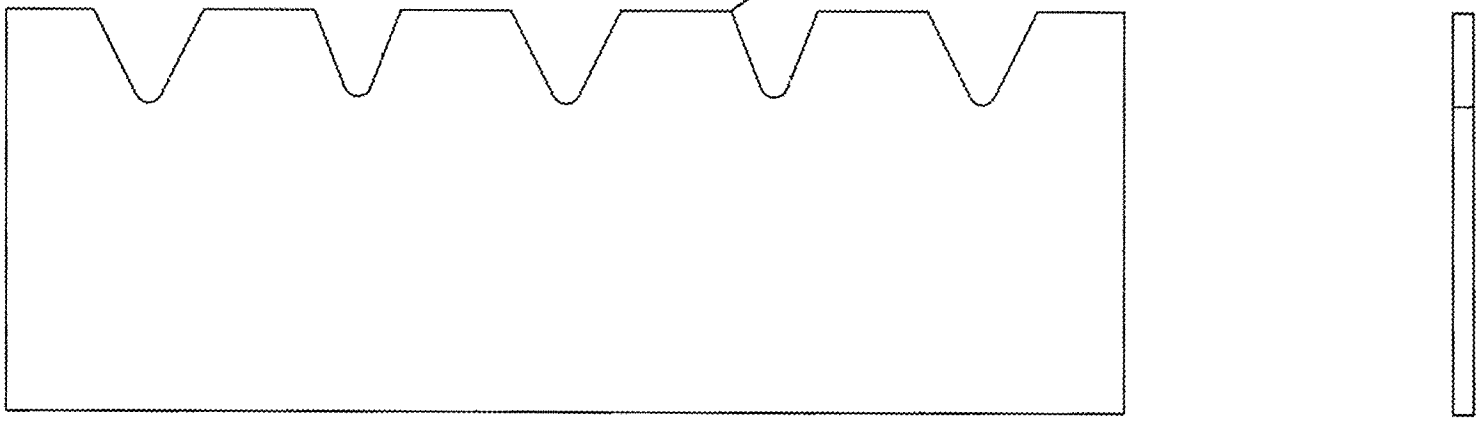
FIG. 30—The front view of the seat guild.
Figure 31:
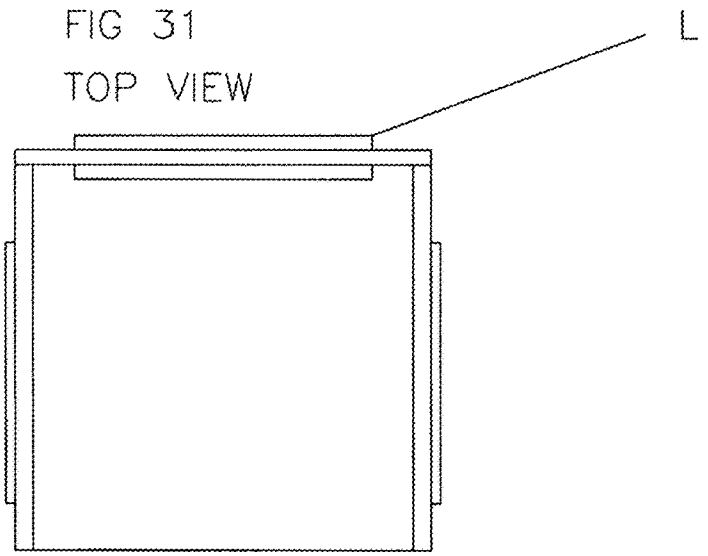
FIG. 31—The top view of the footrest platform with slides and the seat guild attached.
Figure 32:
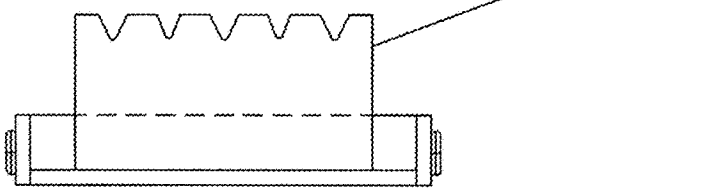
FIG. 32—The front view of the footrest assembly with slides and seat guild attached.
Figure 33:
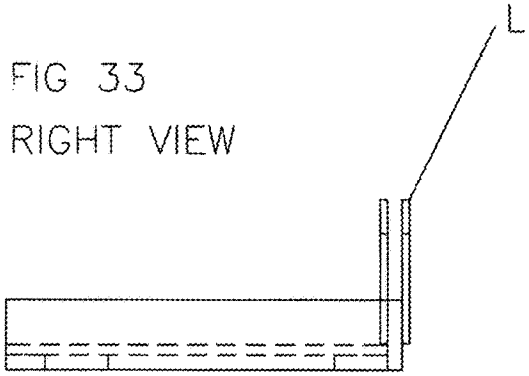
FIG. 33—The right view of the footrest assembly with slides and seat guild attached.

The guides shown in FIG. 30 are semi-connected to the two units shown in FIG. 31, see L. This connection will not interfere with the lift FIG. 37, and will allow the footrest to move horizontally with the sitting unit assembly.

Footrest Assembly Platform

Figure 39:
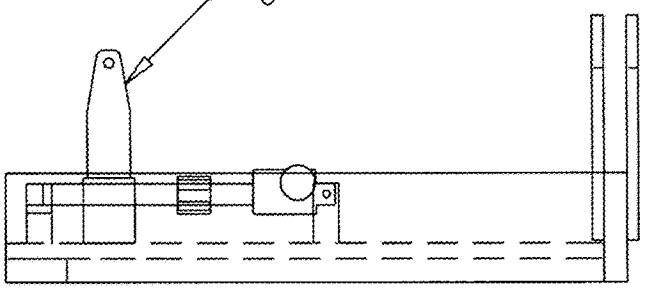
FIG. 39—The right view of the footrest assembly with slides, actuator and seat guild.
Figure 40:
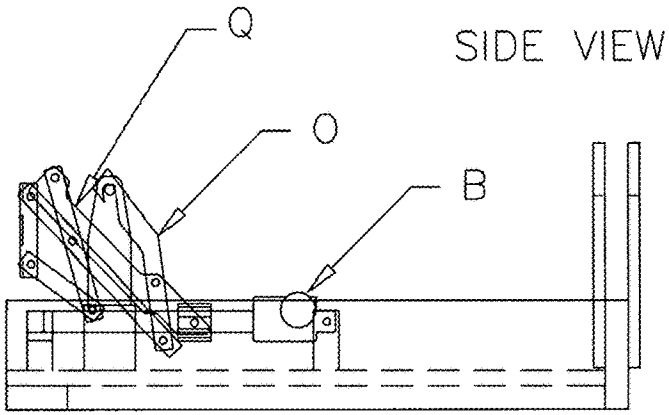
FIG. 40—The right view of the footrest assembly with slides, actuator, linkage and seat guild.
Figure 38:
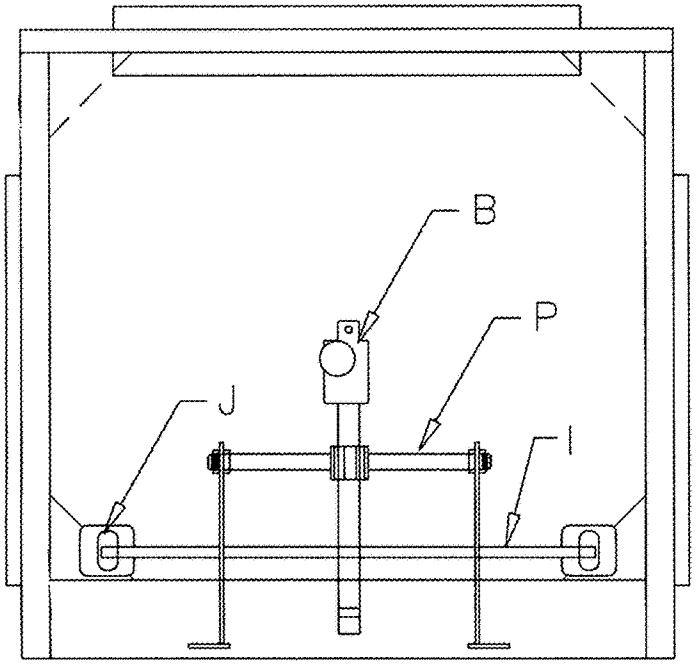
FIG. 38—The top view of the footrest assembly with slides, actuator and seat guild.

The footrest assembly is hand fitted and tested manually before permanently mounting, as alignment is important view FIG. 38 and FIG. 40, a motor/track actuator is mounted to the footrest assembly see B. There are two threaded rods mounted to the tracking portion of the actuator shown in FIG. 38 see P, these rods are securely fastened to the tracking portion of the actuator and the linkage guiding arm shown on FIG. 40-42 see Q. There are two pillow blocks shown in FIG. 38 and FIG. 39, see J, mounted on two blocks for alignment purposes, shown on FIG. 39. B There is a steel shaft connecting the two pillow blocks, shown in FIG. 38 see I, locked in place with setscrews forming the footrest assembly platform.

Figure 42:
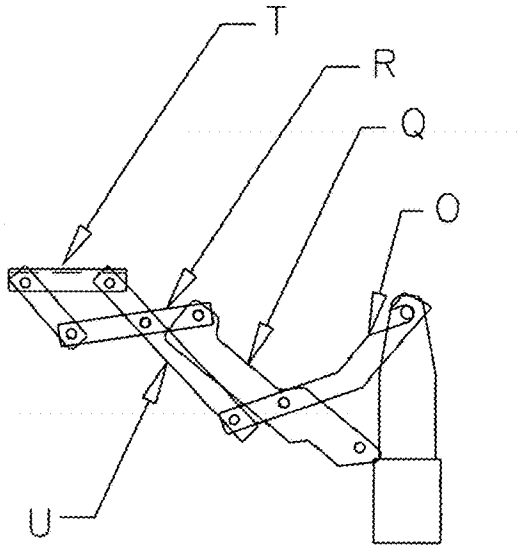
FIG. 42—The side view of the footrest linkage.
Figure 41:
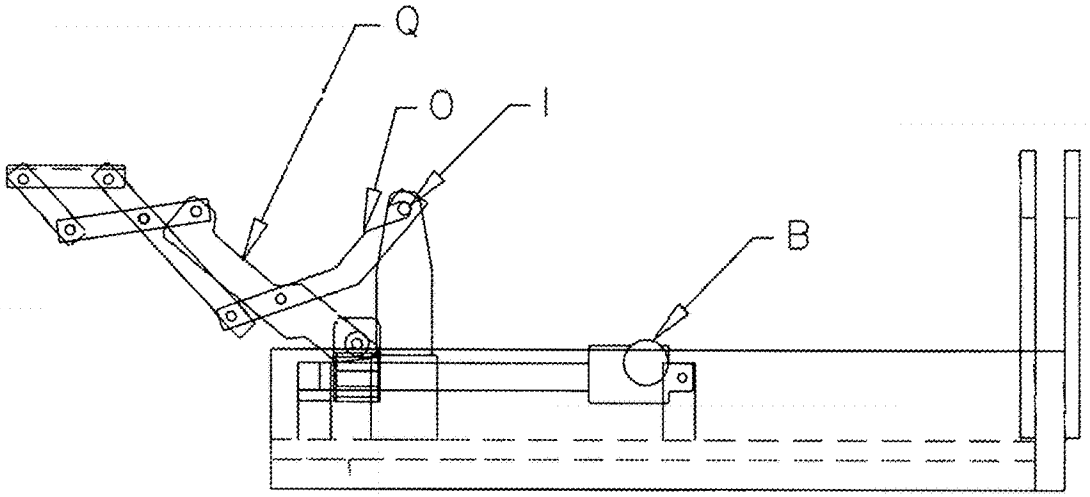
FIG. 41—The side view of the footrest linkage and assembly this view also shows how the actuator pushes and pulls the linkage and how the linkage is supported.

The footrest linkage levers shown in FIG. 42 are riveted together forming the linkage assembly; then the support lever FIG. 40 and FIG. 41 see 0 is placed and hooked on to the steel shaft, shown in FIG. 38 see I; aligning with each actuator guide held in place with a clip on each side, then fastened to the motor/actuator linkage guide, FIG. 40.

When the footrest assembly motor/tracking actuator is activated, it will apply a force to the linkage-guiding lever shown in FIG. 40-42 see Q away from the linkage support lever pivoting in place catapulting a force to linkage levers see U and R, forcing linkage lever—see T—into a horizontal position shown in FIG. 42.

This arching cycle will begin from a vertical start by pressing horizontally against the person's heel then supporting the remainder of the person's legs into a lift that is controlled by the operator with or without the hack reclining.

The invention claimed is:

1. A chair for a living room comprising: a frame; a seat assembly configured to move horizontally relative to the frame for a sitting function and to be lifted from the frame for a lifting function; a footrest assembly comprising a footrest mounted to a footrest platform, the footrest being configured to move independently of the seat assembly movement between a vertical retracted position and a horizontal extended position for supporting the legs of a person seated in the chair; two ball retainer drawer slides horizontally mounted to the frame under the seat assembly; a guide, mounted to the rear of the footrest platform and detachably secured into the seat assembly; and a footrest actuator that controls the movement of the platform is fastened to the two ball retainer drawer slides so that the footrest assembly moves horizontally together with the seat assembly when the guide is secured into the seat assembly; and wherein the guide is configured to allow the seat assembly to detach and separate from the footrest assembly during the lifting function.

2. The chair in claim 1, further comprising: a second set of drawer slides mounted parallel to each other on the seat assembly; a back assembly coupled to the seat assembly and movable together with the seat assembly; and a track actuator attached to the seat assembly to move the seat, back and foot assemblies together horizontally.

3. A chair having a lift function, the chair comprising: a stationary frame configured to horizontally support a seat assembly; the seat assembly comprising: a seat having a front end hinged to the frame, a backrest coupled to the seat such that the seat and backrest lift angularly together and independent of the frame, and a catch assembly having a catch mounted to the rear side of the backrest and a shaft mounted to the rear of the seat; and a lift actuator configured to move the rear of the seat assembly vertically about the front hinge between an inclined position and a declined position; wherein the lift actuator operates to vertically press the rear of the seat assembly toward the inclined position such that the shaft is received into the catch thereby securing and holding the backrest stationary during movement to the inclined position; and wherein the lift actuator operates to vertically lower the rear of the seat assembly toward the declined position, whereby the back rest is secured and held stationary during lowering of the seat assembly and the shaft is released out of the catch in the declined position.

4. The chair in claim 3, wherein a lower portion of the backrest is coupled to the seat to allow horizontal movement with the seat and configured so that an upper portion of the backrest rests against the frame.

* * * * *